US007426884B2

(12) United States Patent
Thiry et al.

(10) Patent No.: US 7,426,884 B2
(45) Date of Patent: Sep. 23, 2008

(54) CIRCUIT ARRANGEMENT

(75) Inventors: Gerd Anton Thiry, Wadgassen (DE); Alois Hoffmann, Saarbrücken (DE); Harald Bär, Püttlingen (DE)

(73) Assignee: Hydac Fluidtechnik GmbH., Sulzbach/Saar (DE)

( * ) Notice: Subject to any disclaimer, the term of this patent is extended or adjusted under 35 U.S.C. 154(b) by 139 days.

(21) Appl. No.: 10/580,197

(22) PCT Filed: Dec. 8, 2004

(86) PCT No.: PCT/EP2004/013927

§ 371 (c)(1),
(2), (4) Date: May 23, 2006

(87) PCT Pub. No.: WO2005/075833

PCT Pub. Date: Aug. 18, 2005

(65) Prior Publication Data

US 2007/0137192 A1 Jun. 21, 2007

(30) Foreign Application Priority Data

Feb. 5, 2004 (DE) ..... 10 2004 005 606

(51) Int. Cl.
*F15B 11/044* (2006.01)
*F15B 11/20* (2006.01)

(52) U.S. Cl. ..... 91/512; 60/426

(58) Field of Classification Search ..... 60/426; 91/512

See application file for complete search history.

(56) References Cited

U.S. PATENT DOCUMENTS 4,756,298 A * 7/1988 Spiegelberg ..... 60/426

FOREIGN PATENT DOCUMENTS

| | | |
|---|---|---|
| FR | 2 754 571 | 4/1998 |
| FR | 2754571 A1 * | 4/1998 |
| JP | 63 115903 | 5/1988 |

* cited by examiner

*Primary Examiner*—Thomas E Lazo
(74) *Attorney, Agent, or Firm*—Roylance, Abrams, Berdo & Goodman, L.L.P.

(57) ABSTRACT

A circuit arrangement includes a load sensing system (LS) with individual loads (10,14) arranged in series forming a series section, and in parallel forming a parallel section. A hydraulic supply circuit (12) includes a supply pump (P) and a runback (16) for fluid. The load sensing system (LS) determines the highest load pressure in the series section and the parallel section. The loads of the parallel section can be actuated independently from the pressure level of the loads of the series section due to the highest load pressure being transferred as a control pressure to a valve unit (18) such that, as long as the load pressure of the parallel section is higher than the load pressure of the series section, the valve unit restricts the runback (16) so that the pressure of the supply pump (P) matches or exceeds the pressure required in the parallel section. Sufficient fluid pressure for the load in the parallel section is ensured independently of the number of loads in the series section.

10 Claims, 1 Drawing Sheet

CIRCUIT ARRANGEMENT

FIELD OF THE INVENTION

The present invention relates to a circuit arrangement with a load sensing system in which individual consumers arranged in series forming a series section and individual consumers arranged in parallel forming of a parallel section to one another are connected to a hydraulic supply circuit with at least one supply pump and a fluid return line. The load sensing system determines the highest load pressure at the time for the series section and the parallel section.

BACKGROUND OF THE INVENTION

A synonym for a load sensing system is the concept of a load pressure reporting system. The system is a hydraulic control system with pressure and volumetric flow matching, specifically to the instantaneous requirements of one or more consumers. Commercially common load sensing systems can be implemented both with a fixed displacement pump and with an adjustable displacement pump.

In hydraulic systems and controls, the individual consumers can be arranged in series and/or parallel to one another in the supply circuit.

In a conventional series connection, the same liquid stream flows through the individual consumers, and the pressures are added to one another. The return of one consumer forms the inflow of the next consumer so that the entire volumetric flow is available to each consumer in succession. The series connection is used especially wherever consumers with low load pressures are present.

The velocity of the consumers is controlled independently of the load pressure, preferably via proportional flow regulators comprising a proportional choke valve and a bypass manometric balance. In this arrangement, the velocities of the two consumers can be set independently of one another, which is a good idea for a plurality of applications.

Consumers connected in parallel conversely are all subject to the same input pressure and volumetric flows. To operate all consumers at the same time with maximum velocity, the supply pump must be dimensioned to be correspondingly large, which is not necessary in a series connection, as shown.

In a load sensing system of this type, the highest load pressure is determined and the pump pressure is raised by a certain amount over this load pressure, for example, by a circulation manometric balance. In a system including a combination of parallel and series connections, a pressure higher than is necessary for the series connection section cannot build up, since there the excess fluid (oil) is routed to the tank via the bypass manometric balances. This bypass arrangement is especially undesirable when higher pressures are needed in the parallel section, for example, to be able to ensure operation of a machine and its parts.

SUMMARY OF THE INVENTION

An object of the present invention is to provide an improved circuit arrangement with a load sensing system, while maintaining known advantages, such that the consumers of the parallel section can be actuated independently of the pressure level of the consumers of the series section and such that higher pressures are available if they are required in the parallel section for the consumers therein.

This object is basically achieved by a circuit arrangement wherein the load pressure which is highest at the time is relayed as the control pressure to a valve unit. If the load pressure of the parallel section is higher than the load pressure of the series section, the valve unit then dramatically chokes the return for fluid until the pressure of the supply pump rises to or over the pressure required in the parallel section. The consumers of the parallel section can then be actuated independently of the pressure level of the consumers of the series section. It is also possible to ensure enough fluid pressure for the respective consumer in the parallel section regardless of the number of consumers in the series section. This circuit arrangement works in an energy-saving manner, since the pump pressure is always raised depending on the load pressure only to the extent necessary.

In one preferred embodiment of the circuit arrangement of the present invention, the valve unit is formed from a hydraulically controllable proportional slide valve, preferably a 2-way proportional slide valve. Based on the proportional slide valve, it is possible to raise the pump pressure of the supply pump only to the extent necessary, providing the beneficial energy-saving operation of the overall system and thus the circuit arrangement.

In another preferred embodiment of the circuit arrangement of the present invention, between the supply pump and the return, a circulation manometric balance is connected to the supply circuit on which the highest load pressure altogether prevails. If a consumer is not active or required, the fluid (oil) with the low pressure loss can be returned via the circulation manometric balance to the tank, which in turn benefits an energy-saving operation.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
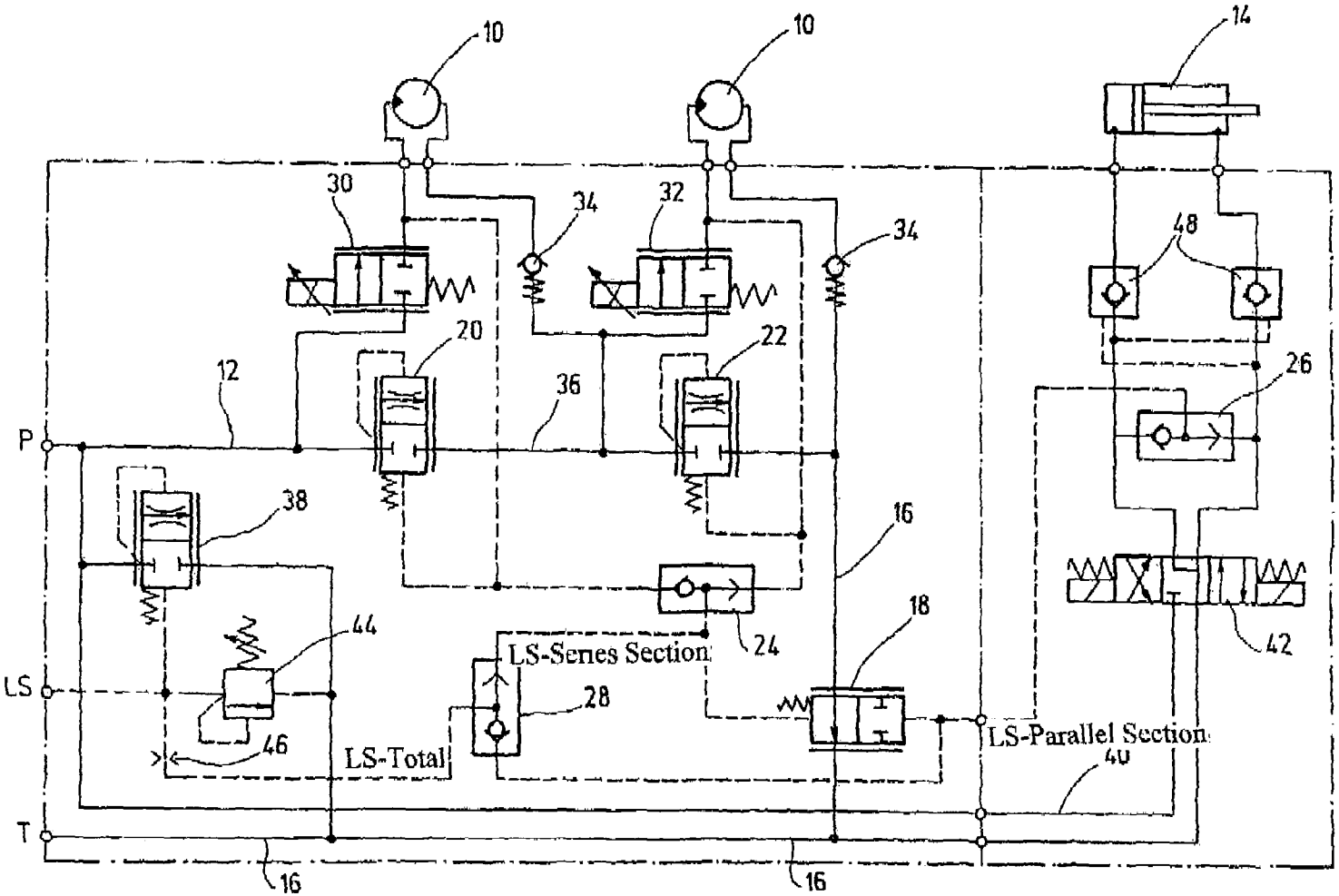
FIG. 1 is a circuit diagram showing the important components of a circuit arrangement according to one embodiment of the present invention.

A circuit arrangement according to an embodiment of the present invention is equipped with a load sensing system labeled LS in the circuit diagram. The circuit arrangement is furthermore characterized in that individual consumers 10 are arranged in succession as series consumers of a series section in the direction of fluid flow. In addition to the series consumers 10 and parallel to them and with the formation of a parallel section, a parallel consumer 14 is connected to the hydraulic supply circuit 12. The series consumers 10 are individual hydraulic motors. The parallel consumer 14 is a conventional hydraulically operating working cylinder. The hydraulic supply circuit 12 discharges or is connected on its free ends into or to a supply pump P and into a tank T. The line of the supply circuit 12 connected to the tank T forms the return 16 of the circuit arrangement.

By the load sensing system LS, it is possible to determine the load pressure which is highest at the time for the series section and for the parallel section as is shown in the circuit diagram by LS-Series and LS-Parallel. The respectively highest load pressure, whether from the series or parallel section, is relayed as control pressure to the valve unit 18 for its triggering. If then, for example, the load pressure of the parallel section with the parallel consumers 14 is higher than the load pressure of the series section with the series consumers 10, the valve unit 18 relative to the return 16 for fluid is dramatically choked until the pressure of the supply pump P rises to or over the pressure required in the parallel section for this consumer 14. Thus, it is possible to actuate and trigger the parallel consumer 14 independently of the pressure level or the series consumers 10 in a manner which was not possible with the existing circuit arrangements with a load sensing system.

Each of the series section and the parallel section has at least of one consumer 10, 14. Preferably, two series-connected consumers 10 of the series section are located in the fluid flow direction in front of the parallel section with a parallel consumer 14. Other consumer configurations are also conceivable, for example, only one series consumer 10 for the series section and two or more parallel consumers for the parallel section (not shown). The valve unit 18 which processes the control pressures of the load sensing system includes a hydraulically controllable proportional slide valve, preferably a 2-way proportional slide valve. Furthermore, a bypass manometric balance 20, 22 is assigned to each consumer 10 of the series section.

One control pressure line for the valve unit 18 is connected to a shuttle valve 24 of the series section. The other control pressure line for valve unit 18 is connected to the shuttle valve 26 of the parallel section and to the shuttle valve 28 of the load sensing system LS. The interconnection is illustrated in the circuit arrangement of FIG. 1. The control inputs of the bypass manometric balances 20, 22 of the series section are each connected to the output of the shuttle valve 24 of the series section. The output of the manometric balance 20 is connected to the input of the manometric balance 22 to carry fluid. The output of the manometric balance 22 discharges into the return line 16 connected on the input side to the valve unit 18.

In the fluid flow direction located upstream from the manometric balance 20, a branch of the series section connects the first consumer 10 to the supply circuit 12. The pertinent supply or flow in that branch can be blocked via a proportional choke valve 30. The output of the consumer 10 which is first in series discharges onto the input side of another proportional choke valve 32 to which the second consumer 10 is connected on the output side. The respective output of the consumer 10 is protected via a non-return valve 34. Furthermore, the input of the proportional choke valve 32 is connected to carry fluid to the connecting line 36 between the two manometric balances 20, 22. The prevailing fluid pressure on the output side of the two proportional choke valves 30, 32 is routed as control pressure both to one side of the manometric balances 20, 22 and also to the shuttle valve 24. On the opposing side of the manometric balances 20, 22, the input-side fluid pressure as control pressure prevails on the indicated manometric balances 20, 22.

Between the supply pump P and the return 16, a circulation manometric balance 38 is connected to the supply circuit 12. The control pressures for this circulation manometric balance 38 are in turn formed on one side by the load sensing system LS and on the other side by the input pressure on the manometric balance 38 itself. The output of the manometric balance 38 is connected to the return 16 to carry fluid. The input side of manometric balance 38 is connected to the supply pump P. This pump supply pressure is also present at the input of a 4/3 way valve 42 by the line 40. The load sensing system LS is secured via a pressure limiting valve 44 and is connected via a choke or diaphragm 46 to the LS-Total Side of the shuttle valve 28.

The output side of the 4/3-way valve 42 discharges in two parallel lines into the shuttle valve 26 and into two nonreturn valves 48 which can be mutually deblocked and which are connected on the output side in turn to the piston and rod space of the working cylinder forming parallel consumer 14.

With the valve arrangement of the present invention with a load sensing system, the consumers 10, 14 are located both in series and in parallel to one another. As shown, all series consumers 10 are equipped with a bypass manometric balance 20, 22. The load pressure which is the highest at the time in the series section and in the parallel section are determined separately from one another and are reported as control pressures, as described, to a hydraulically controlled 2-way proportional slide valve 18. If the pressure of the parallel consumers 14 is above that of the series consumer 10, this valve 18 dramatically chokes the return 16 of the series section until the pump pressure of the supply pump P rises above the pressure required in the parallel section. The altogether highest load pressure is always present on the circulation manometric balance 38 in this case. The disclosed circuit arrangement works in an energy-saving manner, since the pump pressure is always raised depending on the load pressure only as much as necessary. In summary the advantages can be described as follows.

Parallel consumers 14 can be actuated independently of the pressure level of the series consumers 10, the pump pressure of the supply pump P is only raised as far as necessary by the 2-way proportional slide valve 18, and if a consumer 10, 14 is not active, the fluid is routed with a low pressure loss to the tank T by the circulation manometric balance 38.

While one embodiment has been chosen to illustrate the invention, it will be understood by those skilled in the art that various changes and modifications can be made therein without departing from the scope of the invention as defined in the appended claims.

What is claimed is:

1. A circuit arrangement, comprising:

first and second individual series consumers arrange in series with one another and forming a series section;

at least one individual parallel consumer connected in parallel relative to said series consumers in a hydraulic supply circuit;

at least one supply pump within said hydraulic supply circuit;

a fluid return line within said hydraulic supply circuit;

a load sensor connected to said consumers and determining a highest load pressure for said series and parallel sections at a time;

a conduit conveying the highest load pressure at the time as a control pressure to a valve unit, said valve unit being operable to dramatically choke said fluid return line coupled thereto if load pressure in said parallel section is higher than load pressure in said series section until said supply pump raises pressure at least to pressure required in said parallel section; and first and second bypass manometric balances are connected in fluid communication to said first and second series consumers, respectively.

2. A circuit arrangement according to claim 1 wherein said first and second series consumers are located in a fluid flow direction upstream of said parallel section.

3. A circuit arrangement according to claim 1 wherein said valve unit comprises a hydraulically controllable proportional slide valve.

4. A circuit arrangement according to claim 3 wherein said proportional slide valve comprises a 2-way proportional slide valve.

5. A circuit arrangement according to claim 1 wherein said valve unit comprises a first control line connected to a series shuttle valve of said series section and a second control line connected to a parallel shuttle valve of said parallel section and to a load sensing shuttle valve of said load sensor.

6. A circuit arrangement according to claim 5 wherein said bypass manometric balances comprise control inputs that are each connected to an output of said series shuttle valve.

7. A circuit arrangement according to claim 1 wherein a circulation manometric balance is connected between supply pump and said fluid return line to said hydraulic supply circuit on which the highest load pressure prevails.

8. A circuit arrangement according to claim 1 wherein a first proportional choke valve is between said first series consumer and said supply pump, said first series consumer being upstream of said second series consumer; and a second proportional choke valve is connected between said first and second series consumers.

9. A circuit arrangement according to claim 5 wherein mutually deblockable non-return valves are connected between said parallel consumer and said parallel shuttle valve.

10. A circuit arrangement according to claim 1 wherein at least one of said series consumers comprises a hydraulic motor; and said parallel consumer comprises a hydraulic working cylinder.

* * * * *